US011454132B2

(12) United States Patent
Hiller et al.

(10) Patent No.: US 11,454,132 B2
(45) Date of Patent: Sep. 27, 2022

(54) TURBOCHARGER, HAVING A STEEL MATERIAL FOR HIGH-TEMPERATURE APPLICATIONS

(71) Applicant: VITESCO TECHNOLOGIES GMBH, Hannover (DE)

(72) Inventors: Marc Hiller, Munich (DE); Martin Thomas, Munich (DE); Achim Koch, Munich (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 17/282,816

(22) PCT Filed: Oct. 1, 2019

(86) PCT No.: PCT/EP2019/076651
§ 371 (c)(1),
(2) Date: Apr. 5, 2021

(87) PCT Pub. No.: WO2020/070163
PCT Pub. Date: Apr. 9, 2020

(65) Prior Publication Data

US 2021/0388738 A1 Dec. 16, 2021

(30) Foreign Application Priority Data

Oct. 5, 2018 (DE) ..... 102018217057.6

(51) Int. Cl.
*F01D 25/00* (2006.01)
*F01D 17/16* (2006.01)
*F01D 25/24* (2006.01)

(52) U.S. Cl.
CPC ..... *F01D 25/005* (2013.01); *F01D 17/165* (2013.01); *F01D 25/24* (2013.01);
(Continued)

(58) Field of Classification Search
CPC ... C21D 2211/001; C22C 38/02; C22C 38/42; C22C 38/46; C22C 38/48; C22C 38/52;
(Continued)

(56) References Cited

U.S. PATENT DOCUMENTS 6,256,991 B1 7/2001 Schmidt et al.
2006/0191508 A1 8/2006 Otsuka et al.
(Continued)

FOREIGN PATENT DOCUMENTS

CN 102149837 A 8/2011
CN 102149838 A 8/2011
(Continued)

*Primary Examiner* — Jesse S Bogue
(74) *Attorney, Agent, or Firm* — Laurence A. Greenberg; Werner H. Stemer; Ralph E. Locher

(57) ABSTRACT

A turbocharger contains a turbine housing having an accommodating region for a turbine rotor disk of the turbocharger, which accommodating region is arranged centrally with respect to a turbine housing axis, and a turbine spiral channel, which tapers helically toward the accommodating region. A wastegate valve, having a spindle arm and a valve plate arranged on the spindle arm, or a variable exhaust-gas guiding device, having bearing disks and guide vanes, is arranged in the turbine housing. At least one of the: turbine housing, spindle arm and valve plate, or bearing disks and guide vanes, has a steel material for high-temperature applications. The material composition of which contains, in addition to iron, Fe, at least the following alloying constituents in amounts within the specified limits in weight percent: carbon: 0.4-0.5%; silicon: 1.25-1.75%; manganese: 3.0-12.0%; chromium: 19.5-20.5%; nickel: 5.0-6.0%; niobium: 1.00-1.5%. The material composition ensures sufficient temperature resistance of the components.

6 Claims, 2 Drawing Sheets

(52) U.S. Cl.
CPC ..... *F05D 2220/40* (2013.01); *F05D 2250/15* (2013.01); *F05D 2250/25* (2013.01); *F05D 2300/171* (2013.01)

(58) Field of Classification Search
CPC ..... C22C 38/58; F01D 17/165; F01D 25/005; F01D 25/24; F02B 37/162; F02B 37/18; F05D 2220/40; F05D 2250/15; F05D 2250/25; F05D 2300/171; Y02T 10/12
See application file for complete search history.

(56) References Cited

U.S. PATENT DOCUMENTS

| | | | |
|---|---|---|---|
| 2007/0215252 | A1 | 9/2007 | Takabayashi et al. |
| 2011/0176914 | A1 | 7/2011 | Schall et al. |
| 2011/0182749 | A1 | 7/2011 | Schall et al. |
| 2014/0227090 | A1 | 8/2014 | Chintalapati et al. |
| 2016/0032433 | A1 | 2/2016 | Chintalapati et al. |
| 2018/0045105 | A1* | 2/2018 | Tomanec ..... F01D 17/105 |
| 2019/0218935 | A1 | 7/2019 | Thomas et al. |
| 2020/0131595 | A1* | 4/2020 | Hamada ..... C22C 38/48 |

FOREIGN PATENT DOCUMENTS

| | | | |
|---|---|---|---|
| CN | 104651743 | A | 5/2015 |
| DE | 959681 | C | 3/1957 |
| DE | 19727140 | C1 | 12/1998 |
| DE | 102011110481 | A1 | 2/2013 |
| EP | 1612395 | A1 | 1/2006 |
| EP | 1826288 | A1 | 8/2007 |
| EP | 1997921 | A2 | 12/2008 |
| EP | 2765214 | A2 | 8/2014 |
| EP | 2980254 | A1 | 2/2016 |
| WO | 2010036533 | A2 | 4/2010 |
| WO | 2017194282 | A1 | 11/2017 |
| WO | 2018036757 | A1 | 3/2018 |

* cited by examiner

TURBOCHARGER, HAVING A STEEL MATERIAL FOR HIGH-TEMPERATURE APPLICATIONS

BACKGROUND OF THE INVENTION

Field of the Invention

The invention relates to an exhaust-gas turbocharger which has a steel material for high-temperature applications, in particular a steel material which is suitable for use at high temperatures of up to over 1000° C.

The development of new technologies and the further development of corresponding devices and methods toward higher performance and efficiency while at the same time reducing the use of resources very often go hand in hand with increased demands on the materials used with regard to strength, temperature resistance, corrosion resistance and machinability. Furthermore, the price naturally also plays an important role in industrial use.

Such a technological challenge which poses ever greater demands is traditional in automotive engineering and in particular the development of the internal combustion engines used therein.

To reduce fuel consumption and pollutant emissions while achieving unchanged or even increased power of the internal combustion engine, it is increasingly the case that small-volume engine concepts, so-called downsizing concepts, are taken as a starting point, which are equipped with exhaust-gas turbochargers for the purposes of increasing power. Here, in particular in the case of gasoline internal combustion engines, the prevailing high exhaust-gas temperatures of up to over 1000° C. constitute a major challenge for the materials used in the exhaust-gas turbine. There is a tendency here to further increase the operating temperatures in order to be able to more efficiently utilize the thermal energy generated during the combustion. Furthermore, there is also a tendency in gasoline internal combustion engines toward lean operation with lambda close to 1, whereby the exhaust-gas temperatures additionally increase. The thermal load on the materials used in the exhaust-gas region, that is to say also in the turbocharger, thus increases.

The operating principle of an exhaust-gas turbocharger consists in utilizing the energy contained in the exhaust-gas flow to increase the pressure in the intake tract of the internal combustion engine and thus effect better charging of the combustion chamber with atmospheric oxygen and thus allow more fuel, gasoline or diesel, to be converted in each combustion process, that is to say to increase the power of the internal combustion engine.

To this end, the exhaust-gas turbocharger has an exhaust-gas turbine arranged in the exhaust tract of the internal combustion engine, a fresh-air compressor arranged in the intake tract and a rotor bearing arranged therebetween. The exhaust-gas turbine has a turbine housing and a turbine impeller arranged therein, which is driven by the exhaust-gas mass flow. The fresh-air compressor has a compressor housing and a compressor impeller arranged therein, which builds up a boost pressure. The turbine impeller and the compressor impeller are arranged rotationally conjointly on the opposite ends of a common shaft, referred to as the rotor shaft, and thus form what is referred to as the turbocharger rotor. The rotor shaft extends axially between the turbine impeller and compressor impeller through the rotor bearing arranged between the exhaust-gas turbine and fresh-air compressor, and is rotatably mounted in said rotor bearing in the radial and axial directions in relation to the rotor shaft axis. According to this construction, the turbine impeller driven by the exhaust-gas mass flow drives the compressor impeller via the rotor shaft, thereby increasing the pressure in the intake tract of the internal combustion engine, downstream of the fresh-air compressor in relation to the fresh-air mass flow, and thereby ensuring better charging of the combustion chamber with atmospheric oxygen.

Furthermore, a device is generally provided in the turbine housing in order to influence the exhaust-gas mass flow flowing onto the turbine impeller. Here, there are substantially two different devices that are optionally provided. This is, on the one hand, a so-called wastegate valve or, on the other hand, a so-called variable turbine geometry (VTG).

A wastegate valve can be used to direct the exhaust-gas mass flow past the turbine impeller directly into the exhaust tract downstream of the exhaust-gas turbine as required, whereas the variable turbine geometry can be used to influence the direction and the flow rate of the exhaust-gas mass flow that arrives at the turbine impeller.

Depending on the rotational speed and exhaust-gas mass flow of the internal combustion engine, the wastegate valve or the variable turbine geometry is set in a manner dependent on the load requirements in such a way that the rotational speed of the turbine and compressor impellers and the pressure ratio, in particular at the exhaust-gas turbine, can be kept within the desired working range of the exhaust-gas turbocharger.

In order to be able to utilize the heat energy generated during the combustion in the internal combustion engine with higher efficiencies by means of the exhaust-gas turbocharger, the exhaust-gas temperatures are kept as high as possible, as already mentioned. Owing to the hot exhaust gases flowing through the turbine housing, this and the components arranged in the exhaust-gas mass flow are subjected to alternating thermal loading at temperatures of up to over 1000° C. Furthermore, there is a requirement for high strength and dimensional stability of the components with the lowest possible weight, that is to say reduced use of materials.

In order to be able to satisfy these high requirements, steel materials with a usually partially austenitic structure and in particular a high nickel content of up to 40% have hitherto been used. Such materials are for example cast steel materials with the short designation 1.4848 (GX40CrNiSi25-20) and 1.4849 (GX40NiCrSiNb38-19).

The material 1.4848 is distinguished by the following material composition: 0.3-0.5% C; 1.0-2.5% Si; max. 2.0% Mn; max. 0.04% P; max. 0.03% S; 24.0-27.0% Cr; max. 0.5% Mo; 19.0-22.0% Ni; remainder Fe.

The material 1.4849 has the following material composition: 0.3-0.5% C; 1.0-2.5% Si; max. 2.0% Mn; max. 0.03% S; 18.0-21.0% Cr; max. 0.5% Mo; 36.0-39.0% Ni; 1.2-1.8% Nb; remainder Fe.

The high nickel content increases the strength and durability of the materials, in particular at operating temperatures of up to 1050° C. However, nickel is a relatively expensive material, for which reason lower-cost alternatives are sought.

A further high-temperature-resistant material with a very low nickel content, which is used in particular in pressure and steam boiler construction as well as in aerospace engineering and turbine construction, is the material 1.4923 (X22CrMoV12-1), which has the following composition: 0.18-0.24% C; 11.0-12.5% Cr; 0.3-0.8% Ni; 0.8-1.2% V; remainder Fe. In the case of this material, the creep strength and long-time rupture strength are increased by the vanadium content and the increased addition of molybdenum.

However, the strength values drop considerably already at temperatures above 500° C., which considerably limits the use for exhaust-gas turbine housings, as described above.

SUMMARY OF THE INVENTION

The present invention is therefore based on the object of specifying an exhaust-gas turbocharger which has a steel material for high-temperature applications and which is distinguished by low material costs, that is to say in particular with a low nickel content of the material, and, in a temperature range up to over 1050° C., by strength and long-time rupture strength sufficient for use in conjunction with internal combustion engines.

Said object is achieved by means of an exhaust-gas turbocharger having the features according to patent claim 1. Advantageous embodiments and refinements, which may be used individually or, where they do not involve mutually exclusive alternatives, in combination with one another, form the subject matter of the dependent claims.

According to the invention, an exhaust-gas turbocharger having a turbine housing with a receiving region, arranged centrally with respect to a turbine housing axis, for a turbine impeller of the exhaust-gas turbocharger and with at least one turbine spiral duct which tapers in a helical shape toward the receiving region for the turbine impeller is disclosed, wherein, in the turbine housing, there is arranged a wastegate valve with a spindle arm and a flap plate arranged thereon or a variable exhaust-gas guiding device with bearing disks and guide vanes, wherein at least one of the components:

turbine housing, spindle arm and flap plate, or bearing disks and guide vanes, has a steel material for high-temperature applications, the material composition of which has, in addition to iron, Fe, at least the following alloy constituents in amounts within the stated limits in percent by weight:

carbon, C: 0.4-0.5%;
silicon, Si: 1.25-1.75%;
manganese, Mn: 3.0-12.0%;
chromium, Cr: 19.5-20.5%;
nickel, Ni: 5.0-6.0%;
niobium, Nb: 1.00-1.5%.

In a further embodiment of the steel material used in the exhaust-gas turbocharger according to the invention, in particular at least one of the proportions of the alloy constituents silicon and manganese may be specified within narrower limits, such that at least one of these constituents is added at least in amounts within the following limits in percent by weight:

silicon, Si: 1.35-1.65%;
manganese, Mn: 7.0-12.0%.

In particular, the amount of manganese may also be further limited to a proportion of 9.0-12%.

In this way, the desired material properties can be achieved at a higher level with greater reliability.

In the case of the above-stated alloy compositions, in relation to known steel materials for high-temperature applications, it is in particular the combinatively increased proportions of manganese, chromium and niobium, with moderate addition of nickel, that are responsible for the material properties achieved. The stated alloy is distinguished here by high heat resistance and at the same time corrosion resistance, in particular in the aggressive, hot exhaust gases of an internal combustion engine.

Furthermore, additional alloy constituents may possibly be added in order to attain certain properties. For example, the material composition according to the invention may be supplemented by adding at least one of the further alloy constituents mentioned below, in proportions up to at most the respectively stated amounts in percent by weight:

tungsten, W: up to 0.6%;
vanadium, V: up to 0.12%;
copper, Cu: up to 0.25%;
cobalt, Co: up to 1.0%;
sulfur, S: up to 0.03% and
phosphorus, P: up to 0.04%.

That is to say, at least one of these elements is added in a measurable amount but in an amount up to the respectively stated limit. However, it is also possible for two, three, four, five or all of these elements to be added in different combinations, but each only in an amount up to the respectively stated limit.

Depending on the combination, this can have a positive effect on various secondary material properties of the alloy, such as the machinability, weldability, castability, etc.

Furthermore, unavoidable impurities may be included in proportions which are negligible with regard to the material properties.

In a further refined embodiment, the steel material used in the exhaust-gas turbocharger according to the invention is distinguished by the fact that it has the at least one of the above-stated further alloy constituents added to the alloy in proportions of in each case at least the stated amounts in percent by weight:

tungsten, W: at least 0.3%;
vanadium, V: at least 0.06%;
copper, Cu: at least 0.1%;
cobalt, Co: at least 0.5%;
sulfur, S: at least 0.013% and phosphorus, P: at least 0.02%.

In combination with the previously defined upper limits for the added quantities of the further alloy constituents, this results in each case in an amount range:

for tungsten, W: between 0.3 and 0.6%;
for vanadium, V: between 0.06 and 0.12%;
for copper, Cu: between 0.1 and 0.25%;
for cobalt, Co: between 0.5 and 1.0%;
for sulfur, S: between 0.013 and 0.03% and for phosphorus, P: between 0.02 and 0.04%.

Here, the steel material has at least one of these further elements in an amount within the stated amount range. The steel material may however also have two, three, four, five or all of the stated further elements in amounts within the stated limits.

The high manganese content and the further alloy constituents contribute to the further increase in the desired material properties and cause in particular a progressive conversion of ferrite into austenite at elevated material temperatures. In addition, the corrosion resistance is increased.

A further embodiment of the steel material used in the exhaust-gas turbocharger according to the invention is accordingly distinguished by the fact that the steel material has a completely austenitic structure. This leads to a significant reduction in the formation of sigma phases in the material structure and contributes to the attainment and stabilization of the desired material properties.

With the stated material composition of the steel material used in the exhaust-gas turbocharger according to the invention, the material properties required for use in turbine housings for exhaust-gas turbochargers with regard to the minimum yield strength, tensile strength and corrosion resistance are achieved with, at the same time, a greatly reduced nickel content and thus reduced material costs in relation to hitherto customary high-temperature materials.

This is achieved inter alia in that the alloy constituents are, in terms of composition and amount, coordinated with one another and possibly defined within narrow limits such that a high proportion of austenitic structure is formed, ideally up to 100%.

The exhaust-gas turbocharger according to the invention has a turbine housing with a receiving region, arranged centrally with respect to a turbine housing axis, for a turbine impeller of the exhaust-gas turbocharger and with at least one exhaust-gas spiral duct which tapers in a helical shape toward the receiving region for the turbine impeller. A wastegate valve with a spindle arm and with a flap plate arranged thereon, or a variable exhaust-gas guiding device VTG with bearing disks and guide vanes, is arranged in the turbine housing. This corresponds substantially to an arrangement as already described in the introduction. The exhaust-gas turbocharger according to the invention is distinguished by the fact that at least one of the components: turbine housing, spindle arm and flap plate, or bearing disks and guide vanes, has a steel material according to the invention with an alloy composition as described in one of the embodiments described above.

A corresponding exhaust-gas turbocharger is distinguished by a lengthened service life with increased operational reliability. This is achieved by means of the material properties, optimized for the application, of the stated components, in particular with regard to the high temperature resistance, with at the same time a reduced price in relation to conventional components composed of high-alloy nickel alloys.

The features and combinations of features of the embodiments of the subject matter according to the invention that are specified above in the description, insofar as they are not usable alternatively or are not mutually exclusive, can individually, partially or entirely also be used in combination with one another or so as to supplement one another in the development of the subject matter according to the invention, without departing from the scope of the invention.

Corresponding embodiments of exhaust-gas turbochargers according to the invention will be discussed in more detail with the aid of the figures.

DETAILED DESCRIPTION OF THE INVENTION

Parts which are identical in terms of function and designation are denoted by the same reference designations throughout the figures.

The figure shows the basic structure of an exhaust-gas turbocharger 1, with a wastegate valve, as already described in broad terms in the introduction, in a schematically simplified half-sectional illustration.

Figure 1:
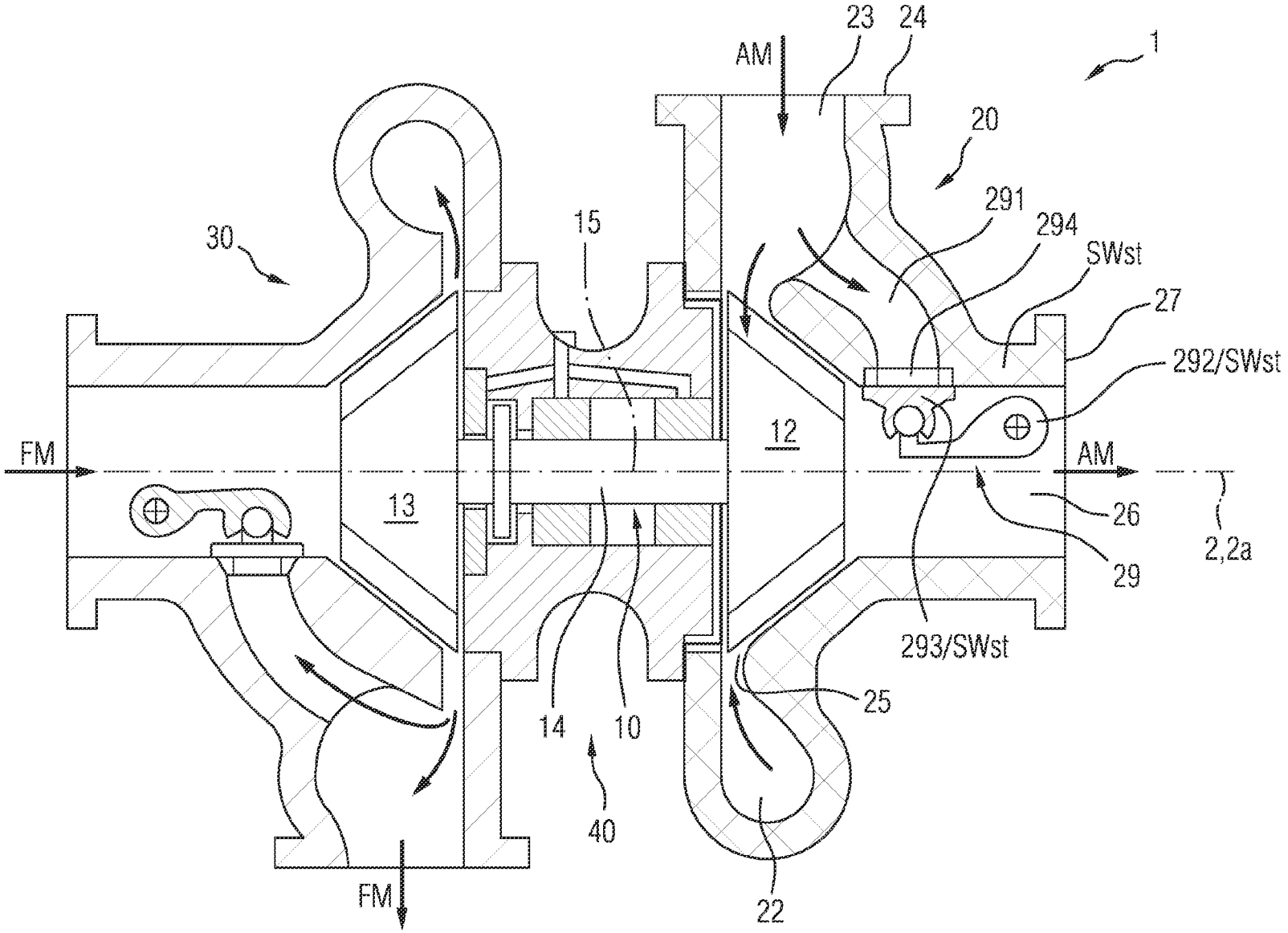
FIG. 1 shows a schematically simplified illustration of an exhaust-gas turbocharger with a wastegate valve, in a half-sectional illustration.
Figure 2:
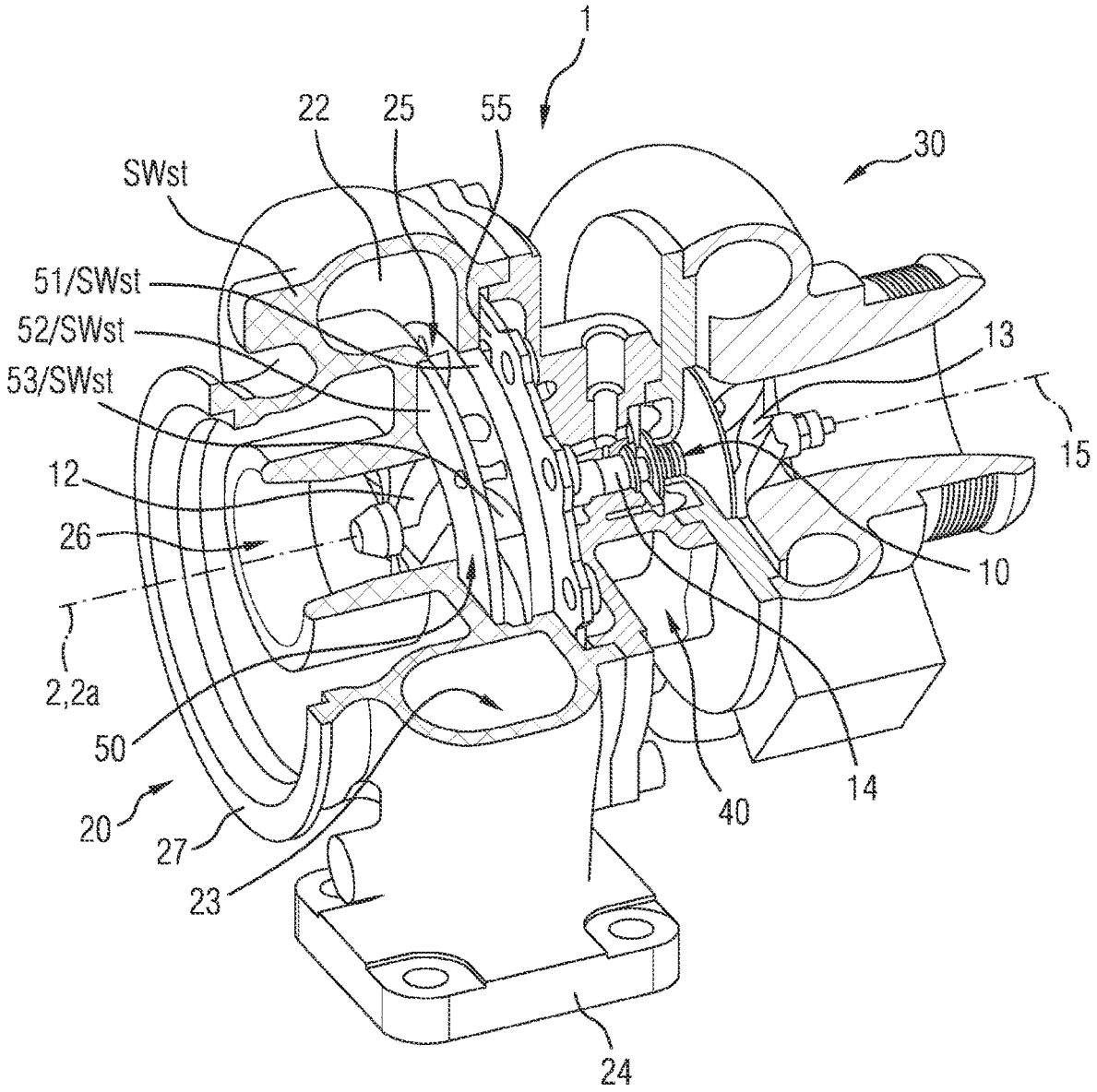
FIG. 2 shows a three-dimensional illustration of an exhaust-gas turbocharger with a variable exhaust-gas guiding device, in a quarter-sectional illustration.

In general, a conventional exhaust-gas turbocharger 1 has, as illustrated in FIGS. 1 and 2, a multi-part structure. Here, a turbine housing 20, which is arrangeable in the exhaust tract of the internal combustion engine, a compressor housing 30, which is arrangeable in the intake tract of the internal combustion engine, and a bearing housing 40 between the turbine housing 20 and compressor housing 30 are arranged in series on a common turbocharger axis 2 and are connected to one another in terms of assembly. A further structural unit of the exhaust-gas turbocharger 1 is the turbocharger rotor 10, which has a rotor shaft 14, a turbine impeller 12, which is arranged in the turbine housing 20, and a compressor impeller 13, which is arranged in the compressor housing 30. The turbine impeller 12 and the compressor impeller 13 are arranged on the opposite ends of the common rotor shaft 14 and connected rotationally conjointly thereto. The rotor shaft 14 extends in the direction of the turbocharger axis 2 axially through the bearing housing 40 and is mounted in the axial and radial directions therein so as to be rotatable about its longitudinal axis, the rotor axis of rotation 15, wherein the rotor axis of rotation 15 lies on the turbocharger axis 2, that is to say coincides therewith. Here, the turbine housing axis **2*a* also lies in a line with the rotor axis of rotation 15 and the turbocharger axis 2. The exhaust-gas mass flow AM through the turbine housing 20 and the fresh-air mass flow FM through the compressor housing 30** are each illustrated by corresponding arrows.

The turbine housing 20 has a turbine spiral duct 22, a so-called exhaust-gas channel, which is arranged in a ring around the turbocharger axis 2 and the receiving region of the turbine impeller 12 and tapers in a helical manner toward the receiving region and the turbine impeller 12, or possibly several in other versions. This exhaust-gas channel has an exhaust-gas feed duct 23, directed tangentially outward, with a manifold connector piece 24 for connection to an exhaust-gas manifold (not illustrated) of an internal combustion engine, through which manifold connector piece the exhaust-gas mass flow AM flows into the respective exhaust-gas channel. The exhaust-gas channel furthermore has an annular gap opening which runs at least over a part of the inner circumference, the so-called exhaust gas inlet gap 25, which runs in an at least partially radial direction toward the turbine impeller 12 and through which the exhaust-gas mass flow AM flows onto the turbine impeller 12.

The turbine housing 20 furthermore has an exhaust-gas discharge duct 26, which runs away from the axial end of the turbine impeller 12 in the direction of the turbocharger axis 2 and has an exhaust connector piece 27 for connection to the exhaust system (not illustrated) of the internal combustion engine. Via this exhaust-gas discharge duct 26, the exhaust-gas mass flow AM emerging from the turbine impeller 12 is discharged into the exhaust system of the internal combustion engine. The steel material SWst according to the invention, which characterizes the turbine housing 20 and from which the turbine housing 20 is manufactured, is symbolized by the cross-hatching.

A wastegate valve 29 connects the exhaust-gas feed duct 23 upstream of the turbine impeller 12 in the flow direction of the exhaust-gas mass flow AM to the exhaust-gas discharge duct 26 downstream of the turbine impeller 12 in the flow direction of the exhaust-gas mass flow AM, via a wastegate duct 291 in the turbine housing 20. The wastegate valve 29 can be opened or closed by means of a closing device. This closing device has a spindle arm 292 which is rotatably mounted in the turbine housing 20 and on which a flap plate 293 is arranged. Both the spindle arm 292 and the flap plate 293 are in this example produced from the steel material SWst according to the invention. By actuation of the spindle arm 292 by means of an external actuator (not shown), the flap plate 293 is, in order to respectively close or open the wastegate valve 29, placed sealingly onto or lifted off from the valve seat 294 of the wastegate duct 291.

By contrast, FIG. 2 shows an embodiment of an exhaust-gas turbocharger 1 with an exhaust-gas guiding device, in this case a variable turbine geometry 50, also referred to as VTG for short. Here, the basic construction of the exhaust-gas turbocharger 1 with turbine housing 20, compressor housing 30, bearing housing 40 and the turbocharger rotor 10 substantially corresponds to the exhaust-gas turbocharger 1 shown in FIG. 1. Instead of a wastegate valve, however, a VTG 50 is provided here. This is composed substantially of two annular bearing disks 51, 52, which are arranged with a certain spacing to one another in the annular-gap-shaped transition region between the turbine spiral duct 22 and the turbine impeller 12 and which thus form the exhaust-gas inlet gap 25. A plurality of guide vanes are arranged between the bearing disks 51, 52 in the exhaust-gas inlet gap 25 so as to be distributed over the circumference of the exhaust-gas inlet gap. These are received in rotatably mounted fashion at least in one of the bearing disks, and their rotational position can be set by means of an actuating mechanism 55 arranged on the rear side of said bearing disk and an external actuator (not illustrated). Both the turbine housing 20 and the bearing disks 51, 52 and the guide vanes 53 are in this embodiment composed of the steel material SWst according to the invention.

The invention claimed is:

1. An exhaust-gas turbocharger, comprising:

a turbine impeller;

a turbine housing having a receiving region, disposed centrally with respect to a turbine housing axis, for said turbine impeller of the exhaust-gas turbocharger, said turbine housing having at least one turbine spiral duct tapering in a helical shape toward said receiving region for said turbine impeller;

a wastegate valve with a spindle arm and a flap plate disposed on said spindle arm or a variable exhaust-gas guiding device with bearing disks and guide vanes, disposed in said turbine housing; and at least one component selected from the group consisting of said turbine housing, said spindle arm and said flap plate, and said bearing disks and said guide vanes, arc formed from a steel material for high-temperature applications, said steel material having a material composition containing iron, Fe, and at least the following alloy constituents in amounts within stated limits in percent by weight:

carbon, C: 0.4-0.5%;

silicon, Si: 1.25-1.75%;

manganese, Mn: 3.0-12.0%;

chromium, Cr: 19.5-20.5%;

nickel, Ni: 5.0-6.0%;

niobium, Nb: 1.00-1.5%;

wherein said steel material contains at least five of further alloy constituents in proportions up to at most with stated amounts in percent by weight:

tungsten, W: up to 0.6%;

vanadium, V: up to 0.12%;

copper, Cu: up to 0.25%;

cobalt, Co: up to 1.0%;

sulfur, S: up to 0.03%; and phosphorus, P: up to 0.04%.

2. The exhaust-gas turbocharger according to claim 1, wherein said steel material has at least one of said alloy constituents at least in amounts within the following limits in percent by weight:

silicon, Si: 1.35-1.65%; and manganese, Mn: 7.0-12.0%.

3. The exhaust-gas turbocharger according to claim 1, wherein said steel material contains said at least one further alloy constituent in proportions of in each case at least in stated amounts in percent by weight:

tungsten, W: at least 0.3%;

vanadium, V: at least 0.06%;

copper, Cu: at least 0.1%;

cobalt, Co: at least 0.5%;

sulfur, S: at least 0.013% and phosphorus, P: at least 0.02%.

4. The exhaust-gas turbocharger according to claim 1, wherein said steel material has a completely austenitic structure.

5. The exhaust-gas turbocharger according to claim 1, wherein said steel material has at least one of said alloy constituents at least in amounts within the following limits in percent by weight:

silicon, Si: 1.35-1.65%; and manganese, Mn: 9.0-12.0%.

6. An exhaust-gas turbocharger, comprising:

a turbine impeller;

a turbine housing having a receiving region, disposed centrally with respect to a turbine housing axis, for said turbine impeller of the exhaust-gas turbocharger, said turbine housing having at least one turbine spiral duct tapering in a helical shape toward said receiving region for said turbine impeller;

a wastegate valve with a spindle arm and a flap plate disposed on said spindle arm or a variable exhaust-gas guiding device with bearing disks and guide vanes, disposed in said turbine housing; and at least one component selected from the group consisting of said turbine housing, said spindle arm and said flap plate, or said bearing disks and said guide vanes formed from a steel material for high-temperature applications, said steel material having a material composition consisting essentially of iron, Fe, and at least the following alloy constituents in amounts within stated limits in percent by weight:

carbon, C: 0.4-0.5%;

silicon, Si: 1.25-1.75%;

manganese, Mn: 3.0-12.0%;

chromium, Cr: 19.5-20.5%;

nickel, Ni: 5.0-6.0%;

niobium, Nb: 1.00-1.5%;

tungsten, W: up to 0.6%;

vanadium, V: up to 0.12%;

copper, Cu: up to 0.25%;

cobalt, Co: up to 1.0%;

sulfur, S: up to 0.03%; and phosphorus, P: up to 0.04%.

* * * * *